US008740452B2

(12) United States Patent
Kaelin et al.

(10) Patent No.: US 8,740,452 B2
(45) Date of Patent: Jun. 3, 2014

(54) PRE-ADJUSTMENT OF TIMEPIECE WHEEL SET SHAKE

(75) Inventors: Laurent Kaelin, Sonvilier (CH); Julien Moulin, Volleges (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 28 days.

(21) Appl. No.: 13/584,287

(22) Filed: Aug. 13, 2012

(65) Prior Publication Data

US 2013/0044574 A1 Feb. 21, 2013

(30) Foreign Application Priority Data

Aug. 17, 2011 (EP) ..... 11177839

(51) Int. Cl.
*G04B 29/00* (2006.01)

(52) U.S. Cl.
USPC ..... 368/318; 368/324

(58) Field of Classification Search
USPC ..... 368/318, 324–326, 228
See application file for complete search history.

(56) References Cited

U.S. PATENT DOCUMENTS

| | | | | |
|---|---|---|---|---|
| 900,380 | A | 10/1908 | Jost | |
| 5,889,738 | A * | 3/1999 | Huter | 368/220 |
| 7,167,420 | B2 * | 1/2007 | Endo et al. | 368/160 |
| 7,630,277 | B2 * | 12/2009 | Conus et al. | 368/220 |
| 7,715,281 | B2 * | 5/2010 | Goeller | 368/72 |
| 8,023,364 | B2 * | 9/2011 | Kojima | 368/220 |
| 8,167,481 | B2 * | 5/2012 | Takeuchi et al. | 368/324 |
| 8,348,495 | B2 * | 1/2013 | Kamiya | 368/101 |

FOREIGN PATENT DOCUMENTS

| | | |
|---|---|---|
| EP | 0 838 736 B1 | 12/2007 |
| JP | 48-3871 | 1/1973 |
| JP | 54-157074 | 11/1979 |

OTHER PUBLICATIONS

European Search Report issued Feb. 13, 2012 in corresponding European Application No. 11 17 7839 filed on Aug. 17, 2011 (with an English Translation).

Japanese Office Action issued Nov. 12, 2013, in Patent Application No. 2012-180825 with English translation.

* cited by examiner

*Primary Examiner* — Sean Kayes

(74) *Attorney, Agent, or Firm* — Oblon, Spivak, McClelland, Maier & Neustadt, L.L.P.

(57) ABSTRACT

Timepiece sub-assembly including a spacer for guiding a pivoting wheel set on a bottom plate and including a shoulder for cooperating with a housing in the bottom plate and a stop surface for abutting against the bottom plate. It includes a drive means fixed to the wheel set, arranged to slide relative to the spacer with an axial shake, determined between a first stop position between a collar of the wheel set and a front face of the spacer, and a second stop position between a stop surface of the drive means and a rear face of the spacer. The wheel set includes, opposite the collar, a machined portion arranged to cooperate with a complementary machined portion of a display element to fixedly secure the display element to the wheel set.

15 Claims, 2 Drawing Sheets

Fig. 1
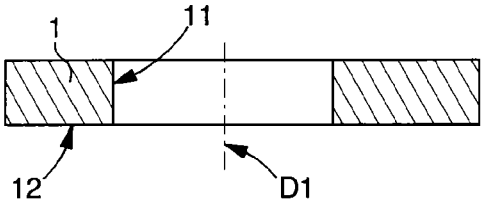
Fig. 2
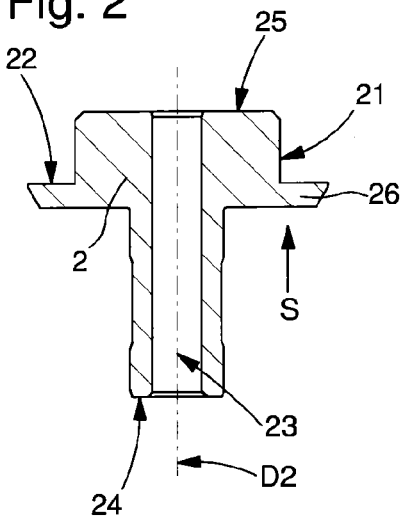
Fig. 3
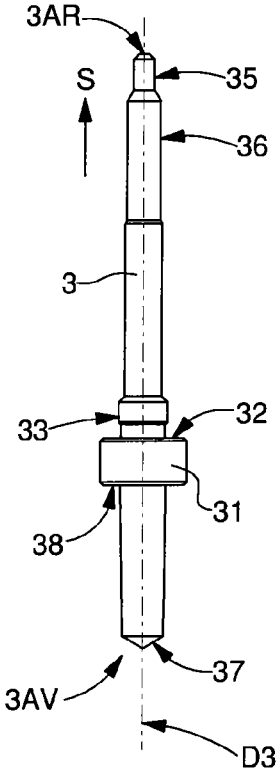
Fig. 3A
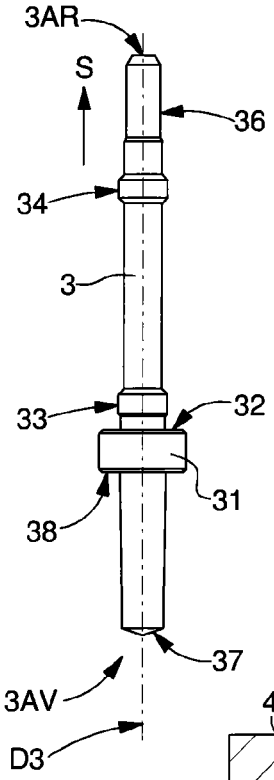
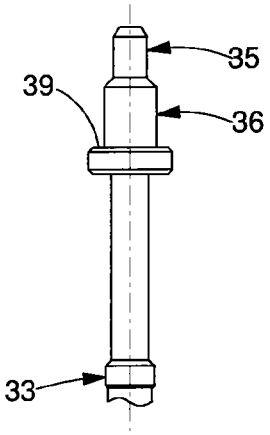
Fig. 3B
Fig. 4
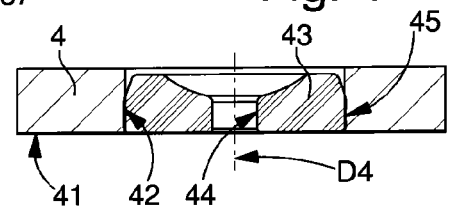
Fig. 5
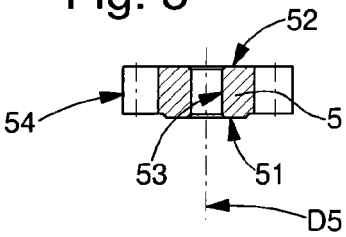
Fig. 4A
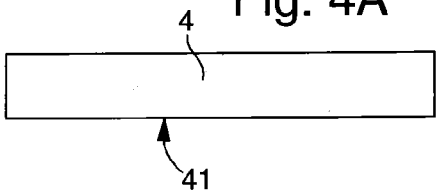

PRE-ADJUSTMENT OF TIMEPIECE WHEEL SET SHAKE

This application claims priority from European Patent Application No. 11177839.5 filed Aug. 17, 2011, the entire disclosure of which is incorporated herein by reference.

FIELD OF THE INVENTION

The invention concerns a timepiece sub-assembly comprising a bottom plate, a wheel set, a spacer for guiding said pivoting wheel set on said bottom plate, said spacer comprising a shoulder arranged to cooperate with a housing in said bottom plate and a stop surface arranged to abut against said bottom plate.

The invention further concerns a timepiece movement comprising at least one such sub-assembly, wherein said bottom plate has a housing extending along a first housing axis, said housing being surrounded on at least one face of said bottom plate by a first bearing surface about said first axis.

The invention further concerns a timepiece comprising at least one timepiece movement of this type, or comprising at least one said bottom plate including a housing extending along a first housing axis, said housing being surrounded on at least one face of said bottom plate by a first bearing surface about said first axis, and having at least one sub-assembly arranged to cooperate with said housing in said bottom plate and with said first bearing surface.

The invention further concerns a method for assembling a timepiece sub-assembly on a bottom plate comprising a housing extending along a first housing axis, said housing being surrounded on at least one face of said bottom plate by a first bearing surface about said first axis. The timepiece sub-assembly comprises, on the one hand, a pivoting timepiece wheel set including a drive shoulder in proximity to a rear axial end, and on the other hand, at least one spacer for receiving in position and guiding the pivoting of said wheel set relative to a bottom plate of this type. The spacer includes a shoulder arranged to cooperate with said housing with a first constriction value or in a fixed hold via rivets or welding or adhesive bonding. Said spacer further includes, on a collar, a second bearing stop surface arranged to abut against said first bearing surface of said bottom plate, and said spacer further includes a front end face at an opposite end to said second bearing stop surface relative to said collar.

The invention concerns the field of horology, and more particularly the assembly of components and the field of repairs, in particularly securing display components, hands, discs or suchlike.

BACKGROUND OF THE INVENTION

Assembling timepiece components by driving them onto each other requires a certain number of precautions. Indeed, numerous components are driven, either onto plates or bars, or onto other intermediate components, particularly in sub-assemblies which are themselves assembled by driving in operations. The stress required to drive in the last component must therefore not be greater than the hold of the weakest component in the stack into which the component is inserted.

This generic problem concerns numerous timepiece assemblies. It will be illustrated here with the example of driving in a centre seconds hand. When this type of hand is driven in, the seconds stone must be held in the gear train bar, to prevent it from moving. Indeed, this is then the worst case scenario where the hold of the stone in its bar is less than the stress necessary to drive in the hand axially. This operation is often hindered by the difficult access to the seconds stone, for example because of the presence of a particular gear train configuration, or an oscillating weight guide element or similar.

JP Utility Model No. 54 157074 U discloses two wheels sets which can move with end-play in relation to each other, and which can both move relative to the same bottom plate.

U.S. patent application Ser. No. 900 380 A in the name of JOST discloses a snap-on cannon-pinion. Elastic components or arm-springs concentrically clamp a first wheel onto the upper shoulder of an arbour, which has a dolly shaped ramp section between two cylindrical sections, when axial stress is exerted as a sleeve is inserted, on the radial supports of these arm-springs, to obtain, in the bottom stop position, a concentric abutment between the sleeve and an arbour carrying a hand.

EP Patent Application No 838 736 A2 in the name of SEIKO does not address any axial shake. It discloses the fixed assembly of a main wheel set on a bar, to act as a means for the internal guiding of a second wheel for the minute display, and for the external and end abutment guiding of a fourth wheel for the seconds display, and also as a spacer between said two wheel sets, particularly to prevent induced vibrations from one to the other. The distal end of the main wheel set includes a groove which cooperates with a shoulder of the fourth wheel.

SUMMARY OF THE INVENTION

The invention proposes to provide a reliable and precise solution to this chronic problem of driving elements into or onto each other, by optimum transmission of the driving force to the bottom plate or to the support element of the assembly into or onto which the component is driven.

The invention therefore concerns a timepiece sub-assembly comprising a bottom plate, a wheel set, and a spacer for guiding said wheel set pivoting on said bottom plate. Said spacer includes a shoulder arranged to cooperate with a housing in said bottom plate and a stop surface arranged to abut against said bottom plate. The timepiece sub-assembly is characterized in that it includes a drive means fixed to said wheel set, arranged to slide relative to said spacer with a determined endshake, between a first stop position between a collar of said wheel set and a front end face of said spacer, and a second stop position between a stop surface of said drive means and a rear end face of said spacer, and in that, on the other side of said collar relative to said drive means, said wheel set includes a machined portion arranged to cooperate with a complementary machined portion comprised in a display element for fixedly attaching said element to said wheel set.

According to one feature of the invention, said housing is surrounded on at least one face of said bottom plate by a first bearing surface around a first axis of said housing, said pivoting timepiece wheel set includes a drive shoulder in proximity to an axial rear end for securing said drive means, said shoulder is arranged to cooperate with said housing with a first constriction value or in a fixed hold via rivets or welds or adhesive bonding, said spacer further includes a second bearing stop surface arranged to abut against said first bearing surface of said bottom plate and said wheel set, equipped with said drive means, slides relative to said spacer, with said wheel set endshake. Said first stop position results from the cooperation between a wheel set reference surface comprised, on the side facing said rear axial end, in said collar, located in proximity to a front axial end of said wheel set opposite said rear axial end and said front end face of said spacer. Said second stop position results from the cooperation between said bearing stop surface and said rear end face of said spacer opposite said front end face, so that, in the assembled position, said collar and said drive means clamp said spacer with said wheel set endshake, and said wheel set includes, at said front axial end located on the other side of said collar relative to said drive shoulder, said machined portion arranged to cooperate with a second constriction value with said complementary machined portion comprised in said display element.

According to a feature of the invention, said spacer and said wheel set are arranged to be mounted coaxially to each other in a single direction of insertion.

According to a feature of the invention, said spacer includes a bore for the axial pivotal guidance of said wheel set, which has a first front shoulder cooperating with said bore in the part thereof which is furthest from said rear end face.

The invention further concerns a timepiece movement including at least one sub-assembly of this type, wherein the bottom plate has a housing extending along a first housing axis, said housing being surrounded on at least one face of said bottom plate by a first bearing surface about said first axis, characterized in that it includes, at a distance from said bottom plate on the opposite side to said first bearing surface, a movement component or a gear train bar including, on the side facing said bottom plate, a first bar reference surface, which, in the assembled position of said sub-assembly on said bottom plate, is separated from a second reference surface comprised in said drive means on the opposite side to said bearing stop surface thereof, by an end-play value which is higher than or equal to the value of said wheel set endshake.

According to a feature of the invention, said movement component or gear train bar includes, either a stone with a bore arranged for guiding the pivoting of a rear pivot comprised, on the side of said axial rear end, in said wheel set, or directly a bore arranged to guide the pivoting of said rear pivot.

The invention further concerns a timepiece including at least one timepiece movement of this type, or including at least one said bottom plate comprising a housing extending along a first housing axis, said housing being surrounded on at least one face of said bottom plate by a first bearing surface about said first axis, and including at least one said sub-assembly arranged to cooperate with said housing in said bottom plate and with said first bearing surface. The timepiece is characterized in that it includes, at a distance from said bottom plate on the opposite side to said first bearing surface, a movement component or a gear train bar comprising, on the side facing said bottom plate, a first bar reference surface which, in the assembled position of said sub-assembly on said bottom plate, is separated from a second reference surface comprised in said drive means on the opposite side to said bearing stop surface thereof, by an end-play value which is higher than or equal to the value of said wheel set endshake.

The invention further concerns a method for assembling a timepiece sub-assembly on a bottom plate comprising a housing extending along a first housing axis, said housing being surrounded on at least one face of said bottom plate by a first bearing surface about said first axis. The timepiece sub-assembly comprises, on the one hand, a pivoting timepiece wheel set including a drive shoulder in proximity to a rear axial end, and on the other hand, at least one spacer for receiving in position and guiding the pivoting of said wheel set relative to a bottom plate of this type. The spacer includes a shoulder arranged to cooperate with said housing with a first constriction value or in a fixed hold via rivets or welding or adhesive bonding. Said spacer further includes, on a collar, a second bearing stop surface arranged to abut against said first bearing surface of said plate, and said spacer further includes a front end face at an opposite end to said second bearing stop surface relative to said collar. The method is characterized in that:

said wheel set is made with a collar located in proximity to a front axial end opposite to said rear axial end, said collar of said wheel set comprising a wheel set reference surface located, on the side facing said rear axial end, in proximity to said front axial end, said wheel set further including, at said front axial end located on the other side of said collar relative to said drive shoulder, a machined portion arranged to cooperate with a second constriction value with a complementary machined portion comprised in a display element for securing the latter securely to said wheel set;

said wheel set is inserted into said spacer, so that said wheel set reference surface is brought opposite said front end face;

a drive means is fixed, by driving in, welding, adhesive bonding, rivets or laser fusion, to said drive shoulder of said wheel set, so as to position a bearing surface of said drive means at a distance from said wheel set reference surface which is set either by adjustment or by the abutment of said drive means on a shoulder, if said wheel set has one, in order to stop said drive means, and a certain wheel set endshake is set around said spacer for the sub-assembly formed of said spacer and said drive means, the pre-assembled sub-assembly formed of said wheel set, said spacer and said drive means is inserted into said housing, with said second bearing stop surface of said spacer abutting against said first bearing surface of said bottom plate, said shoulder cooperating with said housing with a first constriction value or in a fixed hold via rivets or welding or adhesive bonding;

said display element is driven in and secured by causing said complementary machined portion to cooperate with said machined portion for the secure attachment of said display element to said wheel set, with a second constriction value.

BRIEF DESCRIPTION OF THE DRAWINGS

Other features and advantages of the invention will appear upon reading the following detailed description, with reference to the annexed drawings, in which:

FIG. 1 shows a schematic, longitudinal cross-section of a bottom plate arranged to receive a timepiece sub-assembly.

FIG. 2 shows a schematic, longitudinal cross-section of a spacer, formed by a centre tube arranged for assembling a wheel set on a bottom plate of this type.

FIGS. 3, 3A and 3B show schematic, longitudinal cross-sections of wheel set variants arranged to cooperate with a spacer of this type.

FIG. 4 and FIG. 4A show schematic, longitudinal cross-sections of two variants of a gear train bar with reference to which a timepiece sub-assembly, comprising a spacer and wheel set of this type, is arranged, during assembly, in a bottom plate of this type.

FIG. 5 shows a schematic, longitudinal cross-section of a pinion arranged to be fitted to a wheel set of this type.

DETAILED DESCRIPTION OF PREFERRED EMBODIMENTS

Figure 6:
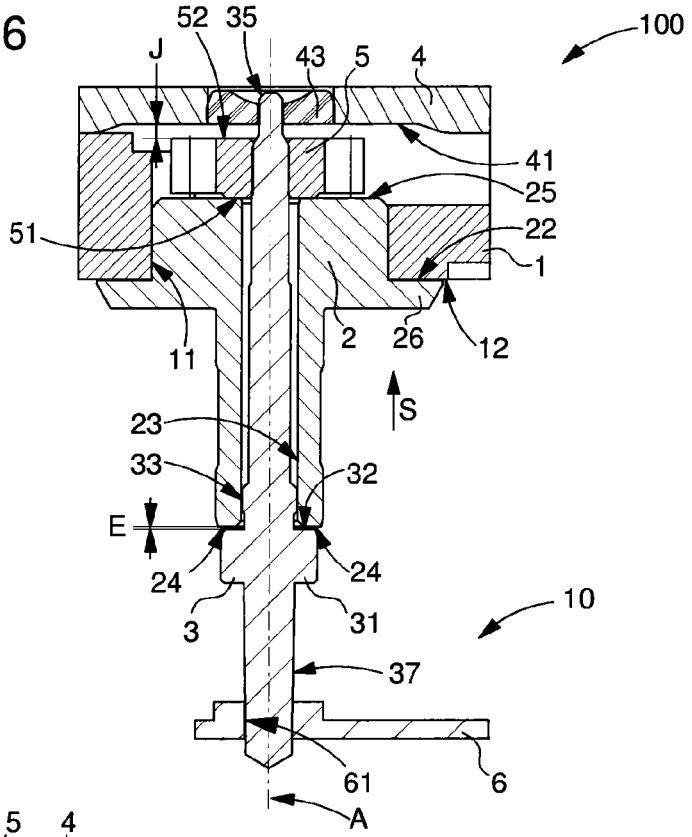
FIG. 6 and FIG. 6A show schematic, longitudinal cross-sections of two alternative methods of assembling a sub-assembly of this type on a bottom plate of this type, with reference to a movement component or gear train bar, wherein said sub-assembly includes a wheel set of this type mounted via a spacer of this type, and said wheel set is used as a support for a display element, which is represented here by a hand.

The invention concerns the field of horology, and more particularly the assembly of components and the field of repairs, in particularly securing display components, hands, discs or suchlike.

As seen in the Figures, the invention concerns a timepiece sub-assembly 10 including a spacer 2 for guiding a pivoting wheel set 3 on a bottom plate 1 with a shoulder 21 cooperating with a housing 11 in said bottom plate 1, and a stop surface 22 abutting against bottom plate 1.

Figure 6A:
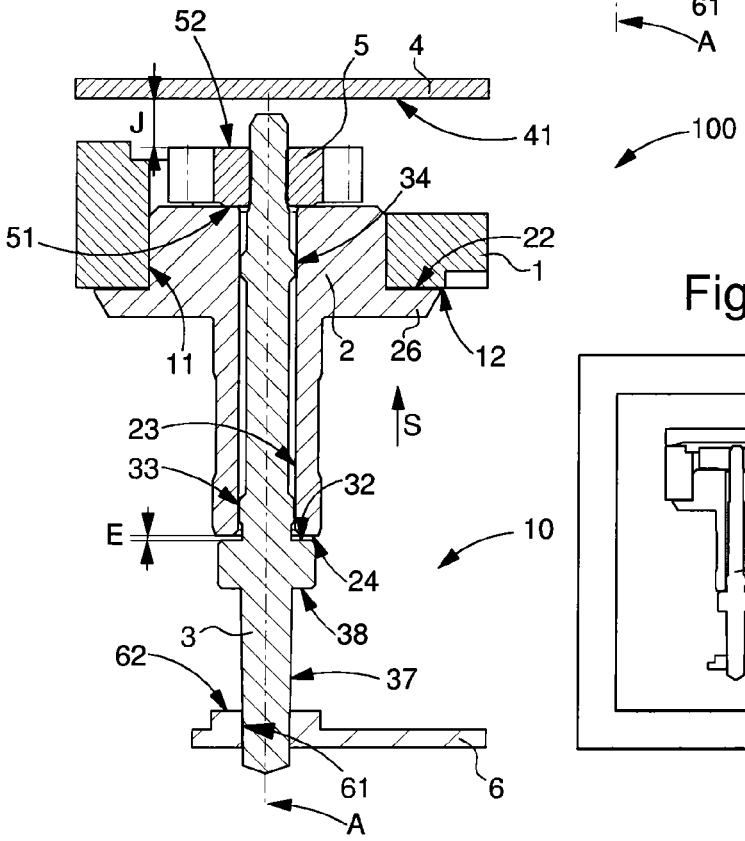
Figure 7:
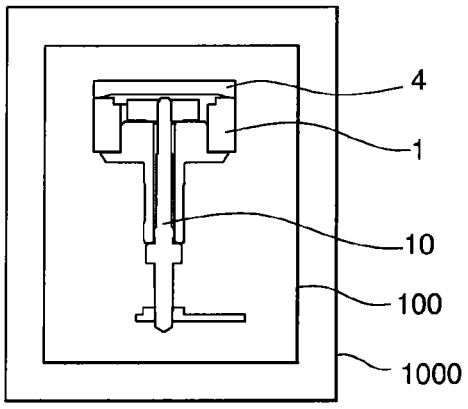
FIG. 7 shows block diagrams of a timepiece including a movement and a sub-assembly according to the invention.

According to the invention, this sub-assembly 10 includes a drive means 5 fixed to wheel set 3. This wheel set 3, equipped with said drive means 5, slides, as seen in FIGS. 6 and 6A, relative to spacer 2, with a determined endshake E between:

- on the one hand, a first stop position between a collar 31 of wheel set 3 and a front end face 24 of spacer 2,
- and on the other hand, a second stop position between a stop surface 51 of drive means 5 and a rear end face 25 of spacer 2.

This wheel set 3, seen in different variants in FIGS. 3, 3A and 3B, includes, on the other side of collar 31 relative to drive means 5, a machined portion 37, which cooperates with a complementary machined portion 61 comprised in a display element 6 for securing said element to wheel set 3.

More precisely, this timepiece sub-assembly 10 is arranged to be fitted to a bottom plate 1 of the type shown in FIG. 1, comprising a housing 11 extending along a first housing axis D1. This housing 11 is surrounded on at least one face of bottom plate 1 by a first bearing surface 12, which is preferably at least partially a surface of revolution, about first axis D1.

Pivoting timepiece wheel set 3 includes a drive shoulder 36 in proximity to a rear axial end 3AR.

Spacer 2, particularly a centre tube, is provided for receiving in position and guiding the pivoting of wheel set 3 relative to said bottom plate 1, and includes a shoulder 21 arranged to cooperate with said housing 11 with a first constriction value or in a fixed hold via rivets or welds or adhesive bonding, or similar, in which case some play is maintained between shoulder 21 and housing 11 to allow the selected method to be implemented. It further includes a second bearing stop surface 22 arranged to abut against the first bearing surface 12 of bottom plate 1.

Drive means 5, particularly a pinion, is secured to drive shoulder 36 of wheel set 3.

The wheel set endshake E is determined by the travel between two stop positions. The first stop position results from the cooperation between, on the one hand a wheel set reference surface 32 comprised, on the side facing the rear axial end 3AR, in a collar 32, located in proximity to a front axial end 3AV of wheel set 3 opposite the rear axial end 3AR, and on the other hand, a front end face 24 comprised in spacer 2.

The second stop position results from the cooperation between, on the one hand, a bearing stop surface 51 comprised in drive means 5, and on the other hand, a rear end face 25 comprised in spacer 2 opposite the front end face 24, so that, in the assembled position, collar 31 and drive means 5 clamp spacer 2 with wheel set endshake E. Wheel set 3 includes, at the front axial end 3AV located on the other side of collar 31 relative to drive shoulder 36, machined portion 37, arranged to cooperate with a second constriction value with complementary machined portion 61 of display element 6.

Spacer 2 and wheel set 3 are arranged to be coaxially mounted in each other in a single direction of insertion S.

Spacer 2 includes a bore 23 for guiding the axial and radial pivoting of wheel set 3. The latter includes at least a first front shoulder 33 cooperating with said bore 23, in the portion thereof which is the furthest from the rear end face 25.

In a particular variant, as seen in FIGS. 3A and 6A, wheel set 3 further includes at least one rear shoulder 34 cooperating with bore 23 between the first front shoulder 33 and the rear end face 25.

In another particular variant seen in FIG. 3B, wheel set 3 includes a shoulder 39 for stopping drive means 5.

In a preferred variant, since it is the most efficient, shown in FIGS. 3 and 6, wheel set 3 includes, on the side of a rear axial end 3AR, a rear pivot 35 arranged to cooperate, with pivoting operating play, with a bore 44 of a stone 43 or a movement component or gear train bar 4. In this configuration, it is only a first front shoulder 33 which provides guidance in bore 23.

In the particular and non-limiting embodiment illustrated in the Figures to explain the invention, drive means 5 is a pinion, spacer 2 is a centre tube, and wheel set 3 is an arbour carrying a display element 6 formed by a hand or display disc, for example a seconds arbour carrying a seconds hand.

In an advantageous and preferred manner, as illustrated in the Figures, the diameter of housing 11 is greater than the largest diameter of drive means 5, so as to allow the insertion into housing 11, in direction S, of a completely pre-assembled sub-assembly 10 comprising spacer 2, wheel set 3, drive means 5 and even display element 6, for example when the watch does not have a dial in proximity to the main pivot axis and when there is no other display means such as a cannon-pinion or an hour wheel concentrically mounted to spacer 2.

In a particular variant, which is not illustrated in the Figures, collar 31 is an added component driven onto wheel set 3, with a holding force generated by a third constriction value between collar 31 and wheel set 3, which is greater than a driving in force associated with the second constriction value between complementary machined portion 61 and machined portion 37. This collar can also be held by another method, welding, riveting or similar, in which case there is no constriction between collar 31 and wheel set 3, but a play that allows implementation of the stopping method selected to secure the collar and wheel set to each other.

The invention further concerns a timepiece movement 100 including at least one bottom plate 1 including a housing 11 extending along a first housing axis D1. This housing 11 is surrounded on at least one face of bottom plate 1 by a first bearing surface 12, which is preferably at least partially a surface of revolution, about first axis Dl. Movement 100 includes at least one said sub-assembly 10, arranged to cooperate with the housing 11 of bottom plate 1 and with the first bearing surface 12.

According to the invention, this movement 100 includes, at a distance from bottom plate 1, and on the opposite side to first bearing surface 12, a movement component or train bar 4 comprising, on the side facing bottom plate 1, a first bar reference surface 41 which, in the assembled position of sub-assembly 10 on bottom plate 1, is separated from a second reference surface 52 comprised in drive means 5 on the opposite side to said bearing stop surface 51 thereof, by an end-play value J, which is greater than or equal to the value of the wheel set endshake E, naturally taking account of tolerances.

This movement component or train bar 4 includes either a stone 43 with a bore arranged for guiding the pivoting of a rear pinion 35 comprised, on the side of the rear axial end 3AR, in wheel set 3, or directly a bore arranged to guide the pivoting of rear pinion 35.

Ensuring an end-play J greater than the wheel set shake E ensure that no force is exerted on the movement component or train bar 4, and particularly on stone 43, in the configuration of FIG. 4. The driving in tolerances of stone 43 in a housing 42 of train bar 4, and certain tolerances peculiar to train bar 4 are therefore avoided.

The shake E can be adjusted during pre-assembly, whereas in the prior art the height at which the stone was driven in had to be re-adjusted.

Although the invention is described above with the preferred configuration where the diameter of housing 11 is greater than the largest diameter of drive means 5, it is naturally possible to drive wheel set 3 via a drive means 5, particular a wheel, of larger diameter than that of housing 11. In such case, wheel set 3, spacer 2 and drive means 5 cannot be pre-assembled to each other. However, the configuration according to the invention of a collar 31 on wheel set 3 and a collar 26 on spacer 2, means that the advantage of bottom plate 1 taking up the axial force exerted when display means 6 is driven onto wheel set 1 is maintained.

A mixed solution consists in inserting an additional component, such as a ring, or a pinion, on the arbour of wheel set 3, abutting on the rear end face 25 of spacer 2, so as to adjust shake E. Drive means 5 can then be mounted further on, towards the rear axial end 3AR of wheel set 3. It must then be checked whether end-play J is greater than or equal to the value of wheel set endshake E.

The invention also concerns a timepiece 1000 including at least one timepiece movement 100 of this type, and/or at least one bottom plate 1 including a housing 11 extending along a first housing axis D1. This housing 11 is surrounded on at least one face of bottom plate 1 by a first bearing surface 12, which is preferably at least partially a surface of revolution, about first axis D1, and comprising at least one sub-assembly 10 arranged to cooperate with housing 11 of bottom plate 1 and with the first bearing surface 12.

According to the invention, this timepiece 1000 includes, at a distance from the bottom plate on the opposite side to first bearing surface 12, a movement component or train bar 4 comprising, on the side facing bottom plate 1, a first reference bar surface 41, which, in the assembled position of sub-assembly 10 on bottom plate 1, is separated from a second reference surface 52 comprised in drive means 5 on the opposite side to bearing stop surface 51 thereof, by an end-play value J which is greater than or equal to the value of wheel set endshake E. This movement component may take various forms, such as a bar or another fixed component relative to the bottom plate, or a moving component such as a barrel or plate, defining a reference surface 41 which represents an insurmountable limit.

The invention further concerns a method for assembling a timepiece sub-assembly 10 on a bottom plate 1 comprising a housing 11, extending along a first housing axis D1, said housing 11 being surrounded on at least one face of bottom plate 1 by a first bearing surface 12, which is preferably at least partially a surface of revolution, about first axis D1. The sub-assembly includes, on the one hand, a pivoting timepiece wheel set 3, including a drive shoulder 36 in proximity to a rear axial end 3AR, and on the other hand, at least one spacer 2 for receiving in position and guiding the pivoting of wheel set 3 relative to bottom plate 1. Spacer 2 includes a shoulder 21 arranged to cooperate in a firm hold with housing 11, preferably with a first constriction value, or in a fixed hold by rivets, welds, adhesive bonds or similar. Spacer 2 further includes, on a collar 26, a second bearing stop surface 22 arranged to abut against the first bearing surface 12 of bottom plate 1, and a front end surface 24 at an opposite end to the second bearing stop surface 22 relative to collar 26.

According to the invention, this wheel set 3 is made to include a collar 31, located in proximity to a front axial end 3AV opposite to rear axial end 3AR, and collar 31 of wheel set 3 includes a wheel set reference surface 32 located, on the side facing rear axial end 3AR, in proximity to front axial end 3AV. This wheel set 3 also includes, at the front axial end 3AV, located on the other side of collar 31 relative to drive shoulder 36, a machined portion 37 arranged to cooperate with a second constriction value with complementary machined portion 61 comprised in a display element 6 for fixedly securing said element to wheel set 3.

According to the invention, the pre-assembly and complete assembly are achieved as follows.

- wheel set 3 is inserted in spacer 2, so as to bring wheel set reference surface 32 opposite to the front end face 24;
- a drive means 5 is driven, welded, bonded, riveted, laser fused or secured by another method to drive shoulder 36 of wheel set 3, so as to position a bearing surface 51 of drive means 5 at a distance relative to wheel set reference surface 32, set either by adjustment, or by the abutment of drive means 5 on a shoulder 39, if wheel set 3 has one, to stop drive means 5 as in the variant of FIG. 3B, and a certain wheel set endshake E is adjusted around spacer 2 for the sub-assembly formed of spacer 2 and drive means 5;
- the pre-assembled sub-assembly formed of wheel set 3, spacer 2 and drive means 5 is inserted into housing 11, with the second bearing stop surface 22 made to abut against the first bearing surface 12 of bottom plate 1, shoulder 21 cooperating with housing 11 with a first constriction value, or fixedly held by a method such as riveting, welding, bonding or similar;
- display element 6 is driven on as complementary machined portion 61 cooperates with machined portion 37 to fixedly secure display element 6 to wheel set 3, with a second constriction value.

Preferably, if, on a reference surface 52 comprised therein and which is opposite bearing surface 51, drive means 5 is in proximity to a reference surface 41 of a movement component or train bar 4 close to bottom plate 1 or arranged to carry a stone 43 for guiding the pivoting of one end of wheel set 3, the wheel set endshake E is adjusted to remain less than or equal to the end-play J between reference surface 52 and reference surface 41, so as to allow axial clearance for the pre-assembled sub-assembly comprising wheel set 3, spacer 2 and drive means 5, relative to bottom plate 1, without any risk of impact of drive means 5 on the movement component or train bar 4.

The object achieved by the invention is that, when display element 6, notably a hand, is driven into place, wheel set 3 abuts on spacer 2, particularly a centre tube, through the collar thereof. The force is thus taken up by bottom plate 1, and not by stone 43 which thus does not require any particular holding device.

The invention offers the advantage of allowing the pre-assembly of wheel set 3 on spacer 2 and preferably with drive means 5 or with a stop element located towards rear axial end 3AR of wheel set 3, so as to adjust shake E prior to the assembly phase T1 of the actual movement 100. The invention therefore avoids certain drawbacks of the prior art.

In particular, any re-adjustment of shake E during phase T1 is avoided.

The design of timepiece 1000 and movement 100 is made simpler, since, owing to the invention it is no longer necessary to provide access to stone 43 in order to wedge it in, in the preferred configuration of FIG. 6, when display element 6 is driven into place. This means that other innovations are possible. For example, in the particular case presented here of mounting a seconds hand on a pivoting seconds arbour in a centre tube, this assembly may be achieved in a cantilever arrangement on a single side of bottom plate 1, without any element passing through the movement. This allows certain components to be arranged at the centre of the movement, such as for example, the winding barrel or a striking barrel or other element, which was impossible in the prior art where the through arrangement of the wheel sets around the main pivot axis prevented any other components from passing through.

The risk of stone 43 moving, particularly here the seconds stone, is avoided, since it no longer takes up the driving in force. Likewise, there is no longer any risk of damaging or breaking the pivot or stone during the driving in operation.

Since end play J is adjusted to be greater than shake E, there is no longer a risk of permanent deformation of the train bar, and consequently there is also no longer a risk of altering the shake of the going train wheel sets.

Thus, it is the entire geometry of the movement which is improved, owing to this design which ensures that axial stress is taken up by the most robust element, in this case, the bottom plate.

What is claimed is:

1. A timepiece sub-assembly comprising a bottom plate, a wheel set, a spacer for guiding said wheel set on said bottom plate, said spacer comprising a shoulder, arranged to cooperate with a housing in said bottom plate, and a stop surface arranged to abut against said bottom plate, wherein said sub-assembly includes a drive means secured to said wheel set, arranged to slide relative to said spacer, with an axial shake, set between a first stop position between a collar of said wheel set and a front end face of said spacer, and a second stop position between a stop surface of said drive means and a rear end face of said spacer, and wherein said wheel set includes, on the other side of said collar relative to said drive means, a machined portion, arranged to cooperate with a complementary machined portion comprised in a display element, to fixedly secure said display element to said wheel set.

2. The timepiece sub-assembly according to claim 1, wherein said housing is surrounded on at least one face of said bottom plate by a first bearing surface about a first axis of said housing, wherein said pivoting timepiece wheel set includes a drive shoulder in proximity to a rear axial end for securing said drive means, wherein said shoulder is arranged to cooperate with said housing with a first constriction value or in a fixed hold via rivets, welds or adhesive bonding, in that said spacer further includes a second bearing stop surface arranged to abut against said first bearing surface of said bottom plate, and wherein said wheel set, equipped with said drive means, slides relative to said spacer, with said wheel set endshake, said first stop position resulting from the cooperation between a reference wheel set surface comprised, on the side facing said rear axial, in said collar located in proximity to a front axial end of said wheel set opposite said axial rear end and said front end face comprised in said spacer, and said second stop position resulting from the cooperation between said bearing stop surface and said rear end face comprised in said spacer opposite said front end face, so that, in the assembled position, said collar and said drive means clamp said spacer with said wheel set endshake and further wherein said wheel set includes, at said front axial end located on the other side of said collar relative to said drive shoulder, said machined portion arranged to cooperate with a second constriction value with said complementary machined portion comprised in said display element.

3. The timepiece sub-assembly according to claim 1, wherein said spacer and said wheel set are arranged to be mounted coaxially in each other in a single direction of insertion.

4. The timepiece sub-assembly according to claim 1, wherein said spacer includes a bore for guiding axially and guiding the pivoting of said wheel set, which includes a first front shoulder cooperating with said bore in the part thereof which is the furthest from said rear end face.

5. The timepiece sub-assembly according to claim 1, wherein said wheel set includes, on the side of a rear axial end, a rear pivot arranged to cooperate, with a pivoting operating play, with a bore of a stone or a bar.

6. The timepiece sub-assembly according to claim 1, wherein said wheel set includes a shoulder for stopping said drive means.

7. The timepiece sub-assembly according to claim 1, wherein said wheel set further includes at least one rear shoulder cooperating with said bore between said first front shoulder and said rear end face.

8. The timepiece sub-assembly according to claim 1, wherein said drive means is a pinion, wherein said spacer is a centre tube, and wherein said wheel set is an arbour carrying one said display element formed by a hand or a display disc.

9. The timepiece sub-assembly according to claim 1, wherein the diameter of said housing is greater than the largest diameter of said drive means.

10. The timepiece sub-assembly according to claim 1, wherein said collar is an added component driven onto said wheel set, with a holding force generated by a third constriction value between said collar and said wheel set which is greater than a driving in force associated with said second constriction value between said complementary machined portion and said machined portion.

11. The timepiece movement including at least one sub-assembly according to claim 1, wherein said bottom plate has a housing extending along a first housing axis, said housing being surrounded on at least one face of said bottom plate by a first bearing surface about said first axis, wherein the timepiece movement includes, at a distance from said bottom plate on the opposite side to said first bearing surface, a movement component or a gear train bar including, on the side facing said bottom plate, a first bar reference surface, which, in the assembled position of said sub-assembly on said bottom plate, is separated from a second reference surface comprised in said drive means on the opposite side to said bearing stop surface thereof, by an end-play value which is greater than or equal to the value of said wheel set endshake.

12. The timepiece movement according to claim 11, wherein said movement component or train bar includes, either a stone with a bore arranged for guiding the pivoting of a rear pinion comprised, on the side of said rear axial end, in said wheel set, or directly a bore arranged for guiding the pivoting of said rear pivot.

13. The timepiece including at least one timepiece movement according to claim 11, or including at least one said bottom plate comprising a housing extending along a first housing axis, said housing being surrounded on at least one face of said bottom plate by a first bearing surface about said first axis, and including at least one sub-assembly according to claim 1, arranged to cooperate with said housing in said bottom plate and with said first bearing surface, further including, at a distance from said bottom plate on the opposite side to said first bearing surface, a movement component or a gear train bar comprising, on the side facing said bottom plate, a first bar reference surface which, in the assembled position of said sub-assembly on said bottom plate, is separated from a second reference surface comprised in said drive means on the opposite side to said bearing stop surface thereof, by an end-play value which is greater than or equal to the value of said wheel set endshake.

14. A method for assembling on a bottom plate comprising a housing extending along a first housing axis, said housing being surrounded on at least one face of said bottom plate by a first bearing surface about said first axis, on the one hand, a pivoting timepiece wheel set including a drive shoulder in proximity to a rear axial end, and on the other hand, at least one spacer for receiving in position and guiding the pivoting of said wheel set relative to said bottom plate, said spacer including a shoulder arranged to cooperate with said housing with a first constriction value or in a fixed hold via rivets or welding or adhesive bonding, said spacer further including, on a collar, a second bearing stop surface arranged to abut against said first bearing surface of said plate, and said spacer further including a front end face at an opposite end to said second bearing stop surface relative to said collar, wherein:

said wheel set is made with a collar located in proximity to a front axial end, opposite to said rear axial end, said collar of said wheel set comprising a wheel set reference surface located, on the side facing said rear axial end, in proximity to said front axial end, said wheel set further including, at said front axial end located on the other side of said collar relative to said drive shoulder, a machined portion arranged to cooperate with a second constriction value with a complementary machined portion comprised in a display element to fixedly secure said element to said wheel set;

said wheel set is inserted in said spacer, so as to bring said wheel set reference surface opposite to said front end face;

a drive means is fixed, by driving in, welding, adhesive bonding, rivets or laser fusion, to said drive shoulder of said wheel set, so as to position a bearing surface of said drive means at a distance from said wheel set reference surface which is set either by adjustment or by the abutment of said drive means on a shoulder, if said wheel set has one, in order to stop said drive means, and a certain wheel set endshake is set around said spacer for the sub-assembly formed of said spacer and said drive means, the pre-assembled sub-assembly formed of said wheel set, said spacer and said drive means is inserted into said housing, with said second bearing stop surface of said spacer abutting against said first bearing surface of said bottom plate, said shoulder cooperating with said housing with a first constriction value or in a fixed hold via rivets or welding or adhesive bonding;

said display element is driven in and secured by causing said complementary machined portion to cooperate with said machined portion for the secure attachment of said display element to said wheel set, with a second constriction value.

15. The assembly method according to claim 14, wherein, if, on a reference surface comprised therein which is opposite said bearing surface, said drive means is in proximity to a reference surface of a movement component or a train bar close to said bottom plate or arranged to carry a stone for guiding the pivoting of one end of said wheel set, the wheel set endshake is adjusted so as to remain less than or equal to an end play between said reference surface and said reference surface, so as to allow axial clearance for the pre-assembled sub-assembly formed of said wheel set, said spacer and said drive means, relative to said bottom plate without any risk of impact of said drive means on said movement component or train bar.

* * * * *